US010865610B2

(12) United States Patent
Carminati et al.

(10) Patent No.: US 10,865,610 B2
(45) Date of Patent: Dec. 15, 2020

(54) DEVICE AND METHOD FOR THE IMPLEMENTATION OF A REFORMABLE TUBULAR STRUCTURE MADE OF COMPOSITE MATERIAL

(71) Applicant: ENI S.p.A., Rome (IT)

(72) Inventors: Stefano Carminati, Monza (IT); Domenico Antonio Di Renzo, Casirate D'adda (IT); Mauro Favaretto, Salzano (IT); Massimo Zampato, Salzano (IT)

(73) Assignee: ENI S.p.A., Rome (IT)

( * ) Notice: Subject to any disclaimer, the term of this patent is extended or adjusted under 35 U.S.C. 154(b) by 75 days.

(21) Appl. No.: 16/316,551

(22) PCT Filed: Jul. 13, 2017

(86) PCT No.: PCT/IB2017/054249

§ 371 (c)(1),
(2) Date: Jan. 9, 2019

(87) PCT Pub. No.: WO2018/011752

PCT Pub. Date: Jan. 18, 2018

(65) Prior Publication Data

US 2019/0234160 A1 Aug. 1, 2019

(30) Foreign Application Priority Data

Jul. 14, 2016 (IT) ..... 102016000073812

(51) Int. Cl.

| | |
|---|---|
| ***E21B 17/20*** | (2006.01) |
| ***E21B 19/22*** | (2006.01) |
| ***E21B 43/10*** | (2006.01) |

(52) U.S. Cl.
CPC ..... *E21B 19/22* (2013.01); *E21B 17/20* (2013.01); *E21B 43/103* (2013.01); *E21B 43/105* (2013.01)

(58) Field of Classification Search
CPC ... B21D 3/02; B21D 3/04; B21D 3/05; B21D 3/14; E21B 17/20; E21B 19/22; E21B 7/20
See application file for complete search history.

(56) References Cited

U.S. PATENT DOCUMENTS

| | | | | |
|---|---|---|---|---|
| 3,361,377 A | | 1/1968 | Trexler, Jr. | |
| 3,631,933 A | * | 1/1972 | Bryant | E21B 7/00 175/57 |
| 4,166,508 A | | 9/1979 | van den Berg | |

(Continued)

FOREIGN PATENT DOCUMENTS

| | | |
|---|---|---|
| WO | WO 00/26500 A1 | 5/2000 |
| WO | WO 2015/128454 A1 | 9/2015 |

OTHER PUBLICATIONS

International Search Report and Written Opinion dated Oct. 11, 2017 in PCT/IB2017/054249, 15 pages.

*Primary Examiner* — Kenneth L Thompson
(74) *Attorney, Agent, or Firm* — Obion, McClelland, Maier & Neustadt, L.L.P.

(57) ABSTRACT

The present invention relates to a device and a method for the implementation of a flexible tubular structure made of reformable composite material, designed for passing from a first folded configuration to a second longitudinally developed operating configuration using a tapered profile slidingly engageable inside the tubular structure.

17 Claims, 3 Drawing Sheets

(56) References Cited

U.S. PATENT DOCUMENTS

| | | | | |
|---|---|---|---|---|
| 4,867,921 | A * | 9/1989 | Steketee, Jr. | B29C 53/10 264/36.17 |
| 5,169,264 | A | 12/1992 | Kimura | |
| 5,346,658 | A * | 9/1994 | Gargiulo | B29B 13/024 156/287 |
| 5,447,665 | A * | 9/1995 | Steketee, Jr. | B26D 3/163 264/36.17 |
| 5,794,702 | A | 8/1998 | Nobileau | |
| 6,454,493 | B1 | 9/2002 | Lohbeck | |
| 7,082,998 | B2 * | 8/2006 | Zamora | D04C 1/06 138/123 |
| 7,217,379 | B2 * | 5/2007 | van Lenthe | B29C 55/26 264/40.7 |
| 2005/0023002 | A1 | 2/2005 | Zamora et al. | |
| 2012/0145381 | A1 | 6/2012 | Nobileau | |
| 2016/0047182 | A1 | 2/2016 | Seweryn et al. | |
| 2016/0362968 | A1 | 12/2016 | Kriesels et al. | |
| 2018/0371849 | A1 * | 12/2018 | Daton-Lovett | E21B 43/105 |

* cited by examiner

DEVICE AND METHOD FOR THE IMPLEMENTATION OF A REFORMABLE TUBULAR STRUCTURE MADE OF COMPOSITE MATERIAL

BACKGROUND OF THE INVENTION

Field of the Invention

The present invention concerns a device and a relative method for the implementation of a flexible reformable tubular structure made of composite material, for transporting fluids (water, oil and/or gas) in the oil & gas industry, particularly advantageous in the completion operations of exploratory, production or injection wells.

Description of the Related Art

The methods for completion operations of exploratory, production or injection wells are normally based on the construction of tubings through modular steel pipes.

The steel pipes used to construct the tubing, normally available in predetermined standard lengths that vary from 9 to 11 metres, are coupled together through male-female threaded joints and then dropped into the well. The installation of a string of pipes is thus a complex and certainly not quick procedure since it requires a series of activities such as: provisioning of the pipes, their transportation, storage, handling and connection to form the production string that is dropped into the well.

Consequently, the conventional ways of finishing the tubing in the well involve dedicated completion rigs, long installation times and the management of heavy and expensive steel pipes. All this is reflected in a substantial total cost of the completion operations.

BRIEF SUMMARY OF THE INVENTION

The purpose of the present invention is to make a device and a method that overcome the drawbacks of the prior art, allowing the completion operations of exploratory, production and injection wells quicker and with less cost impact.

In the present invention, the definition "flexible tubular structure made of composite material" means a structure having a configuration with a longitudinal axis and any transversal section, comprising a pressure-resistant structure, an inner wall that defines an inner passage, a plurality of layers of different materials, the structure being characterised by behaviour that allows for large deflections without compromising the integrity of the structure itself.

The present invention relates to a device 100 for the implementation of a flexible tubular structure 150 made of reformable composite material. The flexible tubular structure 150 made of reformable composite material is designed to pass from a first folded configuration to a second longitudinally developed operating configuration, obtaining a reformed tubular structure 160. The device 100 comprises a reforming system 110 characterised by a profile 500 tapered according to a longitudinal direction. The tapered profile 500 is slidingly engageable inside the flexible tubular structure 150 made of reformable composite material, so that the longitudinal direction of the tapered profile 500 substantially coincides with the longitudinal axis of the reformed tubular structure 160 and so that the surface of any transversal section of the reformed tubular structure 160, in the second operating configuration, is larger with respect to the surface of the same transversal section of the flexible tubular structure 150 made of reformable composite material in the first folded configuration.

The present invention also relates to a method for implementing a flexible tubular structure 150 made of reformable composite material comprising the steps of:

- preparing a flexible tubular structure 150 made of reformable composite material in a first folded configuration;
- extending the flexible tubular structure 150 made of reformable composite material causing it to acquire a second longitudinally developed operating configuration, exerting a pulling action along the substantially longitudinal direction of the structure itself;
- reforming the flexible tubular structure 150 made of reformable composite material in the second operating configuration, obtaining a reformed tubular structure 160 so that the surface of any transversal section of the reformed tubular structure 160 in the second operating configuration is larger with respect to the surface of the same transversal section of the flexible tubular structure 150 made of reformable composite material in the first folded configuration.

The method is characterised in that the step of reforming the flexible tubular structure 150 is executed with the use of a profile 500 tapered according to a longitudinal direction, slidingly engageable inside the flexible tubular structure 150 made of reformable composite material so that the longitudinal direction of the tapered profile 500 substantially coincides with the longitudinal axis of the reformed tubular structure 160.

BRIEF DESCRIPTION OF THE SEVERAL VIEWS OF THE DRAWINGS

The characteristics and advantages of the present invention will become clear from the following description of a non-limiting embodiment thereof with reference to the figures of the attached drawings, in which.

DETAILED DESCRIPTION OF THE INVENTION

Figure 1:
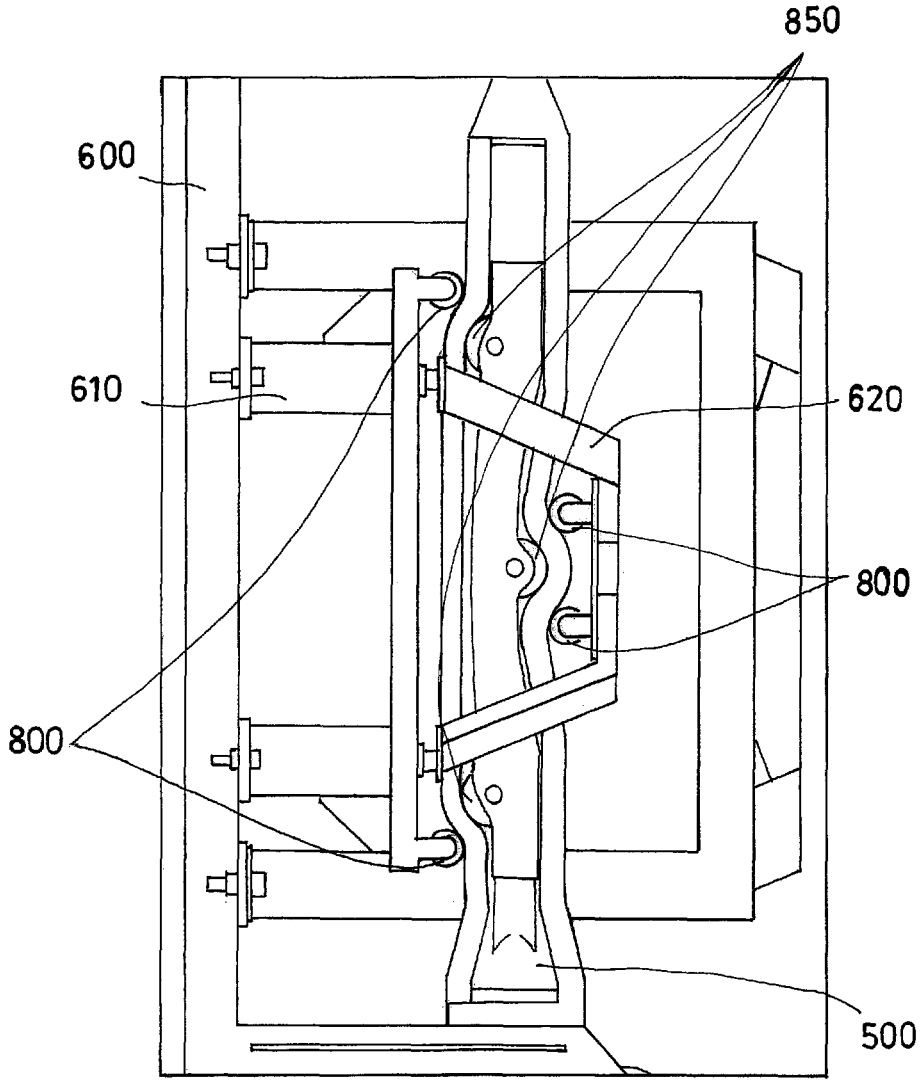
FIG. 1 is a schematic view of the reforming system 110 of the flexible tubular structure 150 made of reformable composite material, including the main elements necessary for operation and with parts omitted for the sake of clarity.
Figure 2:
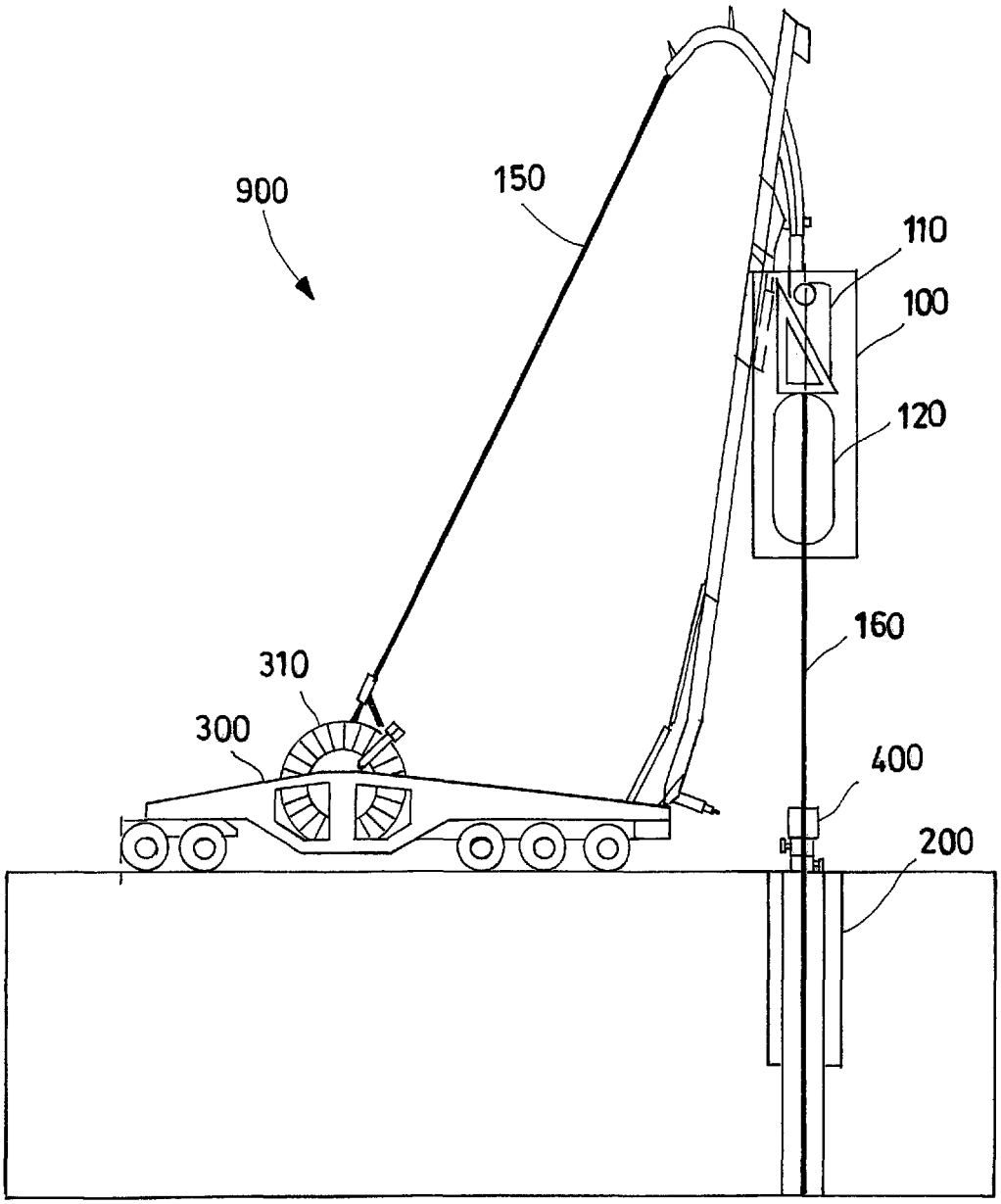
FIG. 2 is a schematic view of the implementation system 900, with parts omitted for the sake of clarity.

With reference to FIGS. 1 and 2, object of the present invention is a device 100 for the implementation of a flexible tubular structure 150 made of reformable composite material that makes it possible to make a tubing or a casing for exploratory, production or injection wells in the oil & gas industry characterised by the advantages described hereinafter. The device 100 object of the invention comprises a reforming system 110.

The flexible tubular structure 150 made of reformable composite material is manufactured with a geometry of transversal section corresponding to that desired in the second operating configuration once the flexible tubular structure 150 is reformed. Since the reformed tubular structure 160 can have a transversal section selected from various geometries, preferably circular or elliptical or ellipsoidal or rectangular or square, the initial flexible tubular structure 150 made of reformable composite material will be manufactured in accordance with the desired reformed configuration in relation to the specific foreseen use, either for the transportation of fluids on the surface or in the well.

The flexible tubular structure 150 made of reformable composite material is subjected to traction so as to take it from a first folded configuration to a second operating configuration that is longitudinally developed by applying a suitable traction force in the longitudinal direction to the flexible tubular structure 150 itself.

In order to make the flexible tubular structure 150 take up the shape of the second operating configuration, the reforming system 110 comprises a longitudinally tapered profile 500 that, when engaged inside the flexible tubular structure 150, allows the relative sliding thereof and at the same time defines the shape thereof.

The longitudinally tapered profile 500 will have a shape dependent on the transversal section that it is wished to obtain for the reformed tubular structure 160 in the second operating configuration.

In a preferred embodiment of the invention, the reformed tubular structure 160 in the second operating configuration is characterised by having a substantially circular transversal section, obtainable by sectioning the reformed tubular structure 160 according to a plane perpendicular to the longitudinal axis.

In a preferred embodiment of the invention, the reforming system 110 of the device 100 object of the present invention comprises a fixed frame 600, outside the flexible tubular structure 150 made of reformable composite material. The fixed frame 600 is provided with external sliding means 800 with respect to the outer wall of the flexible tubular structure 150 made of reformable composite material. The tapered profile 500 comprises internal sliding means 850 with respect to the inner wall of the flexible tubular structure 150 made of reformable composite material. The external sliding means 800 and the internal sliding means 850 are suitable for guiding and facilitating the passage of the flexible tubular structure 150 made of reformable composite material.

Since the tapered profile 500 is longitudinally engaged inside the flexible tubular structure 150, there is the problem of how to prevent the movement of the flexible tubular structure 150 itself pulling the profile 500, thus preventing the forming operation.

In a preferred embodiment of the invention, therefore, the fixed frame 600 of the reforming system 110 of the device 100 object of the invention comprises a primary fixed frame 610 and a secondary fixed frame 620. The primary fixed frame 610 and the secondary fixed frame 620 are provided with the external sliding means 800 configured so as to interfere with the internal sliding means 850, blocking the movements of the tapered profile 500 both in the longitudinal direction with respect to the flexible tubular structure 150 made of reformable composite material, and in the direction perpendicular to said longitudinal direction, guaranteeing the sliding of the flexible tubular structure 150.

With the configuration described above, the reforming system 110 gives the desired shape to the flexible tubular structure 150 made of reformable composite material, guaranteeing that it can slide through the reforming system 110, keeping the tapered profile 500 in position and avoiding undesired translations or rotations thereof.

In a preferred embodiment, the external sliding means 800 are rolls or wheels or bearings or bushings or skates or supports coated with a low-friction material or any combination thereof.

In a further preferred embodiment, the internal sliding means 850 are rolls or wheels or bearings or bushings or skates or supports coated with a low-friction material or any combination thereof.

The combination of the external sliding means 800 and of the internal sliding means 850 supports the tapered profile 500 and prevents it from moving together with the flexible tubular structure 150 due to the friction forces between the inner surface of the flexible tubular structure 150 and the outer surface of the tapered profile 500. The internal sliding means 850 are mounted on the tapered profile 500 and, consequently, move with it. With reference to FIG. 1, the movement along the longitudinal direction of the flexible tubular structure 150 takes the internal sliding means 850 to interfere with the external sliding means 800, leaving sufficient space only for the passage of the flexible tubular structure 150 and actually preventing both the movement of the tapered profile 500, and the rotation thereof. The flexible tubular structure 150, on the other hand, thanks to the external sliding means 800 and to the internal sliding means 850, will continue to slide provided that it is subjected to a suitable axial load. The axial load will have to be greater than that necessary to overcome the force necessary to reform the flexible tubular structure 150 while it passes through the external sliding means 800 and the internal sliding means 850.

The flexible tubular structure 150 made of reformable composite material is hardened through a polymerization mechanism that acts on a polymerizable compound with which the flexible tubular structure 150 itself is impregnated. The impregnation step of the flexible tubular structure 150 can be effected either before or after reforming. In a preferred embodiment of the invention, the flexible tubular structure 150 made of reformable composite material, in its first folded configuration, is already impregnated with a polymerizable compound.

The flexible tubular structure 150 made of reformable composite material, after having been reformed in the second operating configuration and impregnated with a polymerizable compound, is hardened through a polymerization mechanism.

In a preferred embodiment of the invention, the device 100 also comprises a polymerization system 120 of the flexible tubular structure 150 made of reformable composite material impregnated with a polymerizable compound.

In a further preferred embodiment of the invention, the device 100 comprises a polymerization system 120 that uses at least one ultraviolet-ray lamp that acts on the flexible tubular structure 150 made of reformable composite material to activate the polymerization process.

In a further preferred embodiment of the invention, the device 100 comprises a polymerization system 120 that uses at least one electric or infrared heater that acts on the flexible tubular structure 150 made of reformable composite material to activate the polymerization process.

In a further preferred embodiment of the invention, the device 100 comprises a polymerization system 120 that uses at least one electron beam emission gun that acts on the flexible tubular structure 150 made of reformable composite material to activate the polymerization process.

In a further preferred embodiment of the invention, the device 100 comprises a polymerization system 120 that uses at least one microwave radiation generator that acts on the flexible tubular structure 150 made of reformable composite material to activate the polymerization process.

The device 100 of the present invention thus allows the reforming, preferably in rigid cylindrical shape, of a flexible tubular structure 150 made of composite material, impregnated with a suitable resin that, before the reforming and polymerization process, can be folded and/or spooled. In particular, the flexible tubular structure 150 can be spooled on a cylindrical reel 310, preferably with small bending radius, in environmental conditions (temperature, illumination) that prevent the unwanted polymerization process during storage and guarantee the ability to be polymerized when required without deterioration of the mechanical characteristics foreseen, thus minimizing the spaces occupied and facilitating the transportation to the installation site thereof.

Figure 3:
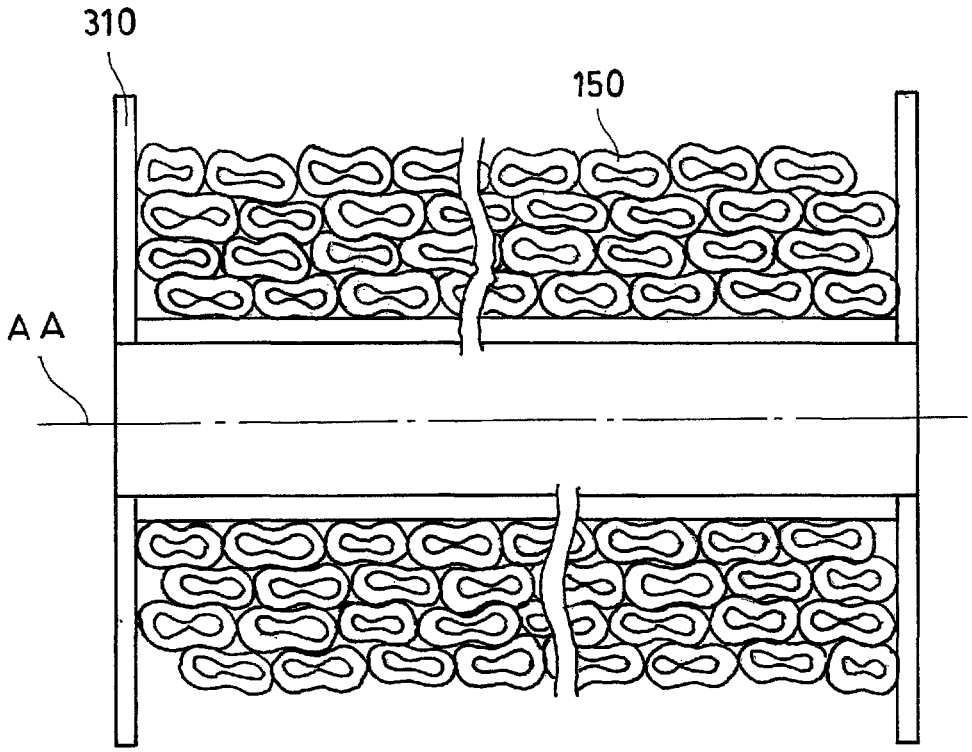
FIG. 3 represents a cross section view on a plane containing the rotation axis AA of a reel or spool 310 on which the flexible tubular structure 150 made of reformable composite material is spooled, with parts omitted for the sake of clarity.

In a preferred embodiment of the present invention, according to FIG. 3, the flexible tubular structure 150 made of reformable composite material, in the first folded configuration, is spooled around a reel or spool 310 making a winding with squashed transversal section, promoting the effective exploitation of space.

When the installation thereof is required, the flexible tubular structure 150 is unspooled and conveyed through the reforming system 110 and the polymerization system 120. A suitable traction system 400 guarantees that the flexible tubular structure 150 made of reformable composite material has a constant pull and advancing speed, in particular with reference to the part where the polymerization process is taking place through a thermal, chemical or irradiation action that starts a rapid polymerization of the polymerizable compound.

In a preferred embodiment to complete exploratory, production or injection wells in the oil & gas industry, the flexible tubular structure 150 is unspooled and taken above the well 200, with a vertical part from 1.5 to 15 metres on the axis of the hole of the well 200, making it pass through the reforming system 110 and the polymerization system 120. At the entrance of the well 200, a suitable traction system 400 guarantees that the flexible tubular structure 150 has a constant pull and advancing speed, in particular with reference to the vertical part where the polymerization process is taking place through a thermal, chemical or irradiation action that starts a rapid polymerization of the polymerizable compound.

In a preferred embodiment of the invention the flexible tubular structure 150 made of reformable composite material comprises an inner layer made of thermoplastic material, which gives resistance to the acids and low roughness, and an outer layer, also made of thermoplastic material, which gives resistance to abrasion during the descent into the well. The two layers also have the function of hydraulic containment, whereas a further layer made of composite material, comprising a cooperating fibre obtained by coupling "braiding" and "knitting" processes, gives high mechanical resistance to the flexible tubular structure 150. With respect to a conventional steel pipe, the stratigraphy of the flexible tubular structure 150 has substantially reduced heat conductivity, with positive consequences for the formation of deposits (for example waxes and/or asphaltenes).

In a preferred embodiment of the invention the material of the inner layer of the flexible tubular structure 150 is a fluorinated polymer, more particularly it is polyvinylidene fluoride.

In a further preferred embodiment the material of the outer layer of the flexible tubular structure 150 is polyurethane.

A further object of the present invention is a method for implementing a flexible tubular structure 150 made of reformable composite material comprising the steps of:

- preparing a flexible tubular structure 150 made of reformable composite material in a first folded configuration. The folded configuration can be made with the spooling around reels or rolls, with the folding packed like a bellows or with other per se known methods;
- extending the flexible tubular structure 150 made of reformable composite material causing it to acquire a second longitudinally developed operating configuration, exerting a pulling action along the substantially longitudinal direction of the flexible tubular structure 150 itself. The application of a traction force to the flexible tubular structure 150 ensures that it passes from a first folded configuration, substantially advantageous for transportation and storage, to a second configuration suitable for operation;
- reforming the flexible tubular structure 150 made of reformable composite material in the second operating configuration, obtaining a reformed tubular structure 160 so that the surface of any transversal section of the reformed tubular structure 160 in the second operating configuration is larger with respect to the surface of the same transversal section of the flexible tubular structure 150 made of reformable composite material in the first folded configuration.

The method is characterised in that the step of reforming the flexible tubular structure 150 made of reformable composite material is effected with the use of a tapered profile 500 having the characteristics described earlier.

In a preferred embodiment, the method object of the present invention comprises the further step of impregnating the flexible tubular structure 150 made of reformable composite material with a polymerizable compound.

In a further preferred embodiment, the method object of the present invention comprises the further step of polymerizing the compound by means of a thermal action or a chemical action or irradiation.

The polymerization step can preferably be effected with at least one electron beam emission gun or with at least one ultraviolet-ray lamp. In a preferred embodiment, characterised by a plurality of electron beam emission guns or ultraviolet-ray lamps, said guns or lamps will be arranged circularly around the flexible tubular structure 150.

The polymerization step can also preferably be effected with at least one electric or infrared ray heater. In a preferred embodiment, characterised by a plurality of heaters, they will be arranged circularly around the flexible tubular structure 150.

The polymerization step can also preferably be effected with at least one microwave radiation generator.

The polymerization step through the mechanisms described above is deemed to be per se known in the parameters and in the execution steps applicable to the invention.

It is thus clear how the device 100 for the implementation of a flexible tubular structure 150 made of reformable composite material makes it possible to make a continuous tubing or casing, i.e. not consisting of parts of limited length screwed together, with advantages in terms of containment of the production fluid and of speed of installation. Moreover, the reformed tubular structure 160 is obtained through the foldable and/or spoolable device 100 before reforming, with advantages in terms of space occupied before installation and ease of transportation towards the installation site, and it is reformable in situ immediately before going down into the well.

The reformed tubular structure 160 thus obtained can be dropped into the well without the use of conventional completion rigs, but rather through a movable platform 300 quick and easy to mobilise, thanks to the lower weight per unit length with respect to conventional steel pipes and thanks to the continuous process that does not thus need screwing operations for every single pipe.

Another object of the present invention is a system 900 for the implementation of a flexible tubular structure 150 made of reformable composite material. The system 900 comprises a movable platform 300, a device 100 of the type described above and a well 200.

The device 100 for the implementation of a flexible tubular structure 150 made of reformable composite material of the present invention thus conceived can in any case undergo numerous modifications and variants, all of which are covered by the same inventive concept; moreover, all of the details can be replaced by technically equivalent elements. In practice, the materials used, as well as the shapes and sizes, can be whatever according to the technical requirements.

The scope of protection of the invention is therefore defined by the attached claims.

The invention claimed is:

1. A device for the implementation of a flexible tubular structure made of reformable composite material, said flexible tubular structure for passing from a first folded configuration to a second longitudinally developed operating configuration, obtaining a reformed tubular structure, the device comprising:

a reforming system, wherein the device comprises a profile tapered according to a longitudinal direction, said tapered profile is slidingly engageable inside the flexible tubular structure made of the reformable composite material, so that the longitudinal direction of the tapered profile substantially coincides with the longitudinal axis of the reformed tubular structure and so that the surface of any transversal section of the reformed tubular structure, in the second operating configuration, is larger with respect to the surface of the same transversal section of the flexible tubular structure made of the reformable composite material in the first folded configuration, wherein the reforming system comprises a fixed frame, and wherein the tapered profile is fixed relative to said fixed frame that is stationary.

2. The device according to claim 1, wherein the reformed tubular structure, in the second operating configuration having a substantially circular transversal section, by sectioning the reformed tubular structure according to a plane perpendicular to the longitudinal axis.

3. The device according to claim 1, wherein the fixed frame is outside the flexible tubular structure made of the reformable composite material, said fixed frame is provided with an external sliding mechanism with respect to the outer wall of the flexible tubular structure made of the reformable composite material, and wherein the tapered profile comprises an internal sliding mechanism with respect to the inner wall of the flexible tubular structure made of the reformable composite material, said external sliding mechanism and said internal sliding mechanism guide and facilitate passage of the flexible tubular structure made of the reformable composite material.

4. The device according to claim 3, wherein the fixed frame comprises a primary fixed frame and a secondary fixed frame, said primary fixed frame and said secondary fixed frame being respectively equipped with said external sliding mechanism interferes with said internal sliding mechanism, blocking movement of the tapered profile in both a longitudinal direction with respect to the flexible tubular structure made of the reformable composite material, and also in a direction orthogonal to said longitudinal direction, guaranteeing the sliding of the flexible tubular structure made of the reformable composite material.

5. The device according to claim 3, wherein said external sliding mechanism is a roll, wheel, bearing, bushing, skate, support coated with a low-friction material, or any combination thereof.

6. The device according to claim 3, wherein said internal sliding mechanism is a roll, wheel, bearing, bushing, skate, support coated with a low-friction material, or any combination thereof.

7. The device according to claim 1, comprising a polymerization system of the flexible tubular structure made of the reformable composite material impregnated with a polymerizable compound.

8. The device according to claim 7, wherein the polymerization system comprises at least one ultraviolet-ray lamp which acts on the flexible tubular structure made of the reformable composite material for activating the polymerization process.

9. The device according to claim 7, wherein the polymerization system comprises at least one electric or infrared heater which acts on the flexible tubular structure made of the reformable composite material for activating the polymerization process.

10. The device according to claim 7, wherein the polymerization system comprises at least one electron beam emission gun or at least one microwave generator which acts on the flexible tubular structure made of the reformable composite material for activating the polymerization process.

11. A method for implementing a flexible tubular structure made of reformable composite material, the method comprising:

preparing a flexible tubular structure made of the reformable composite material in a first folded configuration;

extending the flexible tubular structure made of the reformable composite material for a second longitudinally developed operating configuration, exerting a pulling action along the substantially longitudinal direction of said flexible tubular structure;

reforming the flexible tubular structure made of the reformable composite material in the second operating configuration, obtaining a reformed tubular structure so that the surface of any transversal section of the reformed tubular structure, in the second operating configuration, is larger with respect to the surface of the same transversal section of the flexible tubular structure made of the reformable composite material in the first folded configuration, wherein the reforming the flexible tubular structure is effected with use of a profile being tapered according to a longitudinal direction slidingly engageable inside the flexible tubular structure made of the reformable composite material, so the longitudinal direction of the tapered profile substantially coincides with the longitudinal axis of the reformed tubular structure; and providing a reforming system comprising a fixed frame, wherein the tapered profile is fixed relative to said fixed frame that is stationary.

12. The method according to claim 11, further comprising:

impregnating the flexible tubular structure made of the reformable composite material with a polymerizable compound.

13. The method according to claim 12, further comprising:

polymerizing the compound by a thermal action or a chemical action or irradiation.

14. The method according to claim 13, wherein the polymerizing of the compound is with at least one electron beam emission gun or with at least one ultraviolet-ray lamp.

15. The method according to claim 13, wherein the polymerizing of the compound is with at least one electric or infrared-ray heater.

16. The method according to claim 13, wherein the polymerizing of the compound is with at least one microwave radiation generator.

17. A system for the implementation of a flexible tubular structure made of reformable composite material, the system comprising:

a movable platform, the device according to claim 1, and a well.

* * * * *